United States Patent [19]

Schrempp et al.

[11] 3,984,241

[45] Oct. 5, 1976

[54] PHOTOCOPYING PROCESS IN WHICH PHOTOCONDUCTOR BELT IS INCREMENTALLY REPLACED

[75] Inventors: Ernst Schrempp, Norwalk; Henry S. Hazelton, Jr., Fairfield, both of Conn.

[73] Assignee: Pitney-Bowes, Inc., Stamford, Conn.

[22] Filed: Nov. 5, 1974

[21] Appl. No.: 521,115

Related U.S. Application Data

[62] Division of Ser. No. 449,033, March 7, 1974, Pat. No. 3,877,806.

[52] U.S. Cl. ..... 96/1 R; 355/16

[51] Int. Cl.[2] ..... G03G 15/00

[58] Field of Search ..... 355/16, 17; 96/1 R

[56] References Cited

UNITED STATES PATENTS

| | | | |
|---|---|---|---|
| 3,588,242 | 6/1971 | Berlier et al. | 355/16 |
| 3,617,124 | 11/1971 | Haugen et al. | 355/16 |
| 3,843,252 | 10/1974 | Tanaka et al. | 355/16 |
| 3,861,613 | 1/1975 | Tanaka et al. | 355/16 |

*Primary Examiner*—David Klein
*Assistant Examiner*—Judson R. Hightower
*Attorney, Agent, or Firm*—William D. Soltow, Jr.; Albert W. Scribner; Hugh D. Jaeger

[57] ABSTRACT

An apparatus for making photocopies is disclosed with a photoconductor belt adapted to move around a roller assembly with a cartridge which contains belt replacement segments. The roller assembly meshes with the cartridge to enable rapid continuous movement of the photoconductor which passes a flat region where the belt receives a flash exposure of an object. A mechanism and method for continually replacing the photoconductor belt with incremental fresh segments from the cartridge is described to provide gradual replacement thereof with a long effective usable lifetime for the photoconductor belt and cartridge assembly.

7 Claims, 10 Drawing Figures

PHOTOCOPYING PROCESS IN WHICH PHOTOCONDUCTOR BELT IS INCREMENTALLY REPLACED

This is a division of application Ser. No. 449,033 filed Mar. 7, 1974, now U.S. Pat. No. 3,877,806.

FIELD OF THE INVENTION

This invention relates to a photocopy machine. More specifically, this invention relates to a photocopy machine using a photoconductor belt.

BACKGROUND OF THE INVENTION

The xerographic photocopying process has been extensively described and is well understood. Typically, a photoconductive material is mounted on a drum or on an endless belt to hold a latent electrostatic charge image prior to development and transfer to a plain paper copy.

In one type of photocopy machine a photoconductor drum is employed. While the drum is rotated it is exposed to a line image of an object by the relative movement between a slit and an illuminated object. In another type of photocopy machine the drum is replaced with a photoconductor belt which may be endless for continuous motion along a belt path. The belt path is defined by a plurality of roller elements which are spaced to provide a belt path section where the belt is flat while being exposed to a planar image of the object instead of through a moving line image.

The flat photoconductor belt section may be flash exposed. When the light intensity of the flash is sufficiently high, the exposure time may be so short that blurring of the latent image on a continuously moving photoconductor belt is prevented. The short flash exposure of the entire object enables a high speed photocopying operation.

Various materials have been proposed for photoconductors in photocopy machines. One well-known material is made of a selenium material which is capable of producing a substantial number of copies before replacement. Another material may be of the organic type such as described in the patent to Shattuck et al U.S. Pat. No. 3,484,237. However, an organic photoconductor material has a limited useful life and thus requires replacement in a manner such as, for example, taught and shown in the patent to Berlier et al U.S. Pat. No. 3,588,242.

In the Berlier patent a copy drum is described utilizing an organic photoconductor stored as a flexible strip on a supply reel located within the interior of the drum. The photoconductor is fed around the external periphery of the drum and returned to a take-up reel located inside the drum. The entire photoconductor strip used on the drum is periodically automatically replaced with a fresh unused photoconductor on the supply reel after a certain preselected number of copies have been made.

Another approach for replacing a photoconductor belt is described in the patent to Swanke U.S. Pat. No. 3,619,050. In this patent a photoconductor web is stored in a cartridge located near a photoconductor belt path. A photoconductor segment is formed into an endless belt by use of a connecting tow bar and wrapped around appropriate roller elements which define the photoconductor belt path necessary for exposure, transfer and development of the copy. A replacement of the used web is carried out by taking selected segments from the nearby available cartridge supply and feeding this around the rollers and then reconnecting the ends at the two bars to form an endless belt. A complex mechanism for replacement of the photoconductor is described involving substantial manual control.

In the German patent publication 2,309,296, published on Sept. 6, 1973, based upon an application date of Feb. 24, 1973, a photoconductor is formed into an endless loop. The loop forms a removable cassette having a supply roll and a take-up roll. The loop is passed around rollers and a copy platform around which an exposure area and a printing stage are closely grouped. The casette moves back and forth along a straight path during the copying process.

The desirability of using a flash exposure of a flat photoconductor segment may be appreciated. The moving slit mechanism to expose a drum-type photocopier with a line segment is deleted and a relatively convenient and economical optical exposure system can be used. This advantage of the belt photocopier may be appreciated from the large number of belt photocopiers described in the art such as in the patents to Gardner et al U.S. Pat. No. 3,521,950 Hewes et al U.S. Pat. No. 3,661,452 and Swanke U.S. Pat. No. 3,619,050.

Although the photoconductor drum structure disclosed in the Berlier patent effectively provides a long life by virtue of the storage of a replacement section within the drum, the Berlier apparatus still operates with a line segment exposure by virtue of its drum mounting and does not lean itself to the photoconductor belt photocopy machine.

Another disadvantage of the Berlier replacement structure involves the photoconductor belt replacement operation. This is carried out after a preselected number of copies have been made. At such time the entire photocopying process is interrupted until the cycle for replacement of the photoconductor segment extending around the entire drum is completed.

The patent to Begun et al U.S. Pat. No. 2,789,776 discloses an apparatus manually positioning successive lengths of a recording medium on an endless recording track such as on the periphery of a rotating drum. Ratchet wheels are employed to pull successive lengths of the recording medium around the periphery of the drum to expose new lengths for recording or playback.

Although in a photocopy machine one could employ a longer copying life selenium type photoconductor, its cost and manufacturing complexities reduce the desirability for such approach; particularly when the selenium photoconductor in the belt form has a significantly less useful lifetime then selenium in the drum shape.

When an organic photoconductor is employed in a belt form such as shown in the apparatus disclosed in the patent to Swanke, then an undesirable frequent replacement operation must be carried out even though the organic photoconductor is retained in a nearby cartridge.

SUMMARY OF THE INVENTION

In a photocopy machine in accordance with the invention, a photoconductor assembly is formed of a photoconductor belt and a cartridge for storing a fresh supply of photoconductor material. The photoconductor belt and cartridge are moved around a belt path formed for a roller assembly. The rollers in the roller assembly are each provided with a cartridge receiving recess sized to enable the cartridge to mesh with a roller as the belt and cartridge pass over a roller. In this manner the photoconductor belt assembly moves in a continuous manner and in a uniform direction around the belt path.

An advantageous feature of this invention involves a belt advance mechanism which automatically continually and incrementally replaces the photoconductor belt with fresh segments. The incremental advance results in a gradual replacement of the photoconductor belt as copies are being made with an advantageously consistent level of copy quality throughout the useful life of the belt. The incremental replacement further advantageously distributes physical stresses over the length of the photoconductor belt thus reducing the likelihood of physical damage to any one segment.

As described with respect to the preferred embodiment, the incremental advance of the photoconductor belt involves a Geneva drive whose rotational output is reduced to rotate a belt take-up reel located in the cartridge. The Geneva drive may be actuated once during each full copy cycle of the photoconductor belt. The resultant incremental rotation of the take-up reel produces a corresponding incremental replacement of the photoconductor belt. After a large number of copies have been made, the photoconductor belt segment which was used to make copies has been replaced with a corresponding fresh segment from the cartridge.

The cartridge is sized to retain a sufficient supply of photoconductor belt material for a satisfactory lifetime or number of copies. Yet the cartridge is sufficiently light in weight to enable the photoconductor belt to support the cartridge throughout a copy cycle. The cartridge receiving recesses in the rollers are provided with covers whose opening and closing of the recesses are timed with the respective arrival and departure of the cartridge at and from a recess. The covers are curved to provide a continuous cylindrical peripheral roller surface when the cartridge is between the rollers. When the cartridge enters a recess the covers are opened and the cartridge permitted to make a smooth entry into the recess for a correspondingly smooth passage past a roller. In this manner a continuous photoconductor belt motion is accommodated with a traveling belt replacing cartridge.

It is, therefore, an object of the invention to provide a photocopy machine of the belt type with an effectively long cycle life for the photoconductor. It is still further an object of the invention to provide a roller assembly for use in a belt type photocopy machine to enable a photoconductor belt carrying a replacement segment to be continuously moved. It is still another object of the invention to provide a mechanism for the gradual automatic replacement of a photoconductor belt used in photocopy machines. It is still further an object of the invention to provide a convenient method and apparatus for extending the lifetime of a photoconductor belt in photocopy machine.

BRIEF DESCRIPTION OF DRAWINGS

These and other advantages and objects of the invention can be understood from the following detailed description of a preferred embodiment which is described in conjunction with the drawings wherein.

DETAILED DESCRIPTION OF EMBODIMENT

Figure 1:
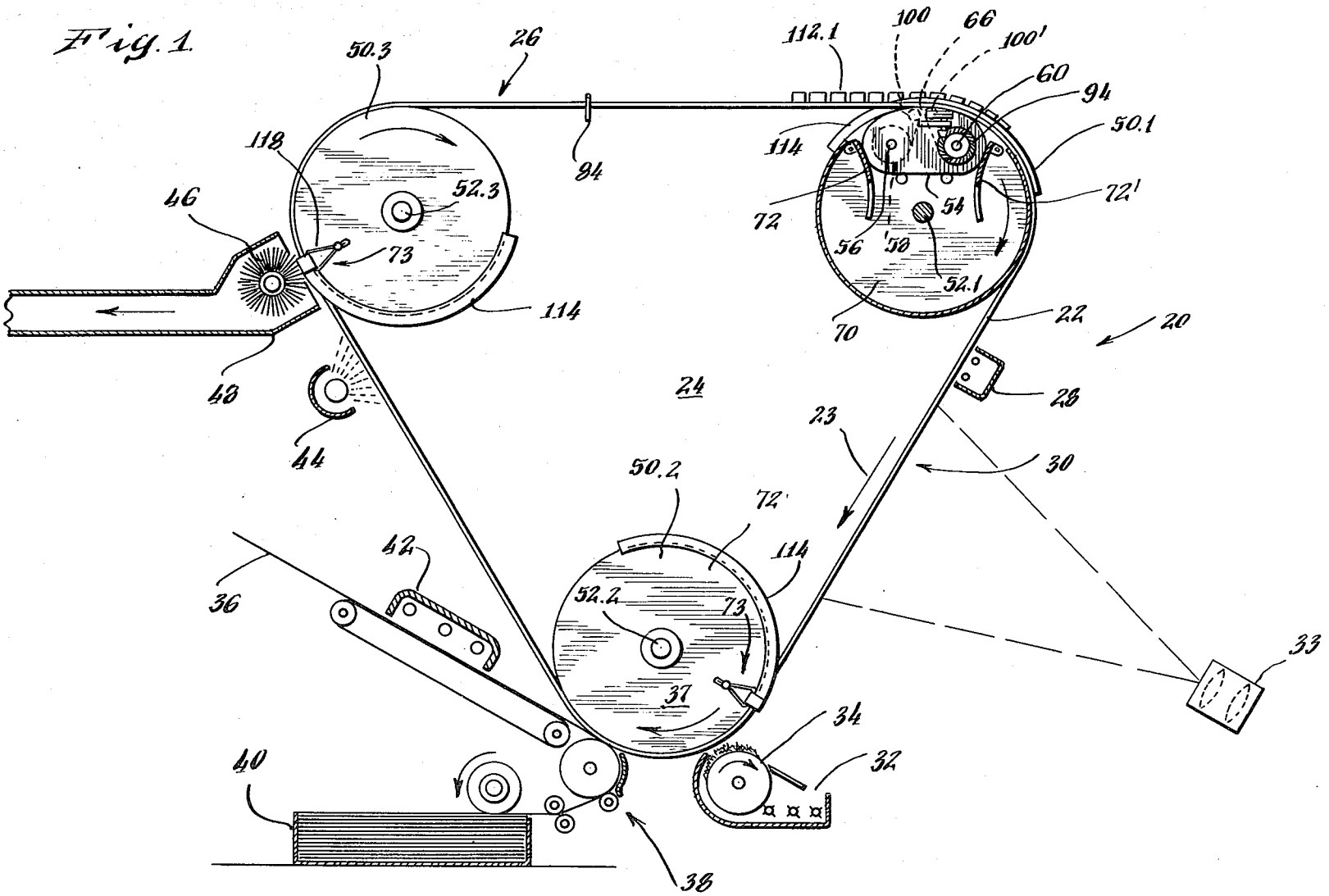
FIG. 1 is a side schematic and partial section view of a photocopy machine of the photoconductor belt type in accordance with the invention.
Figure 2:
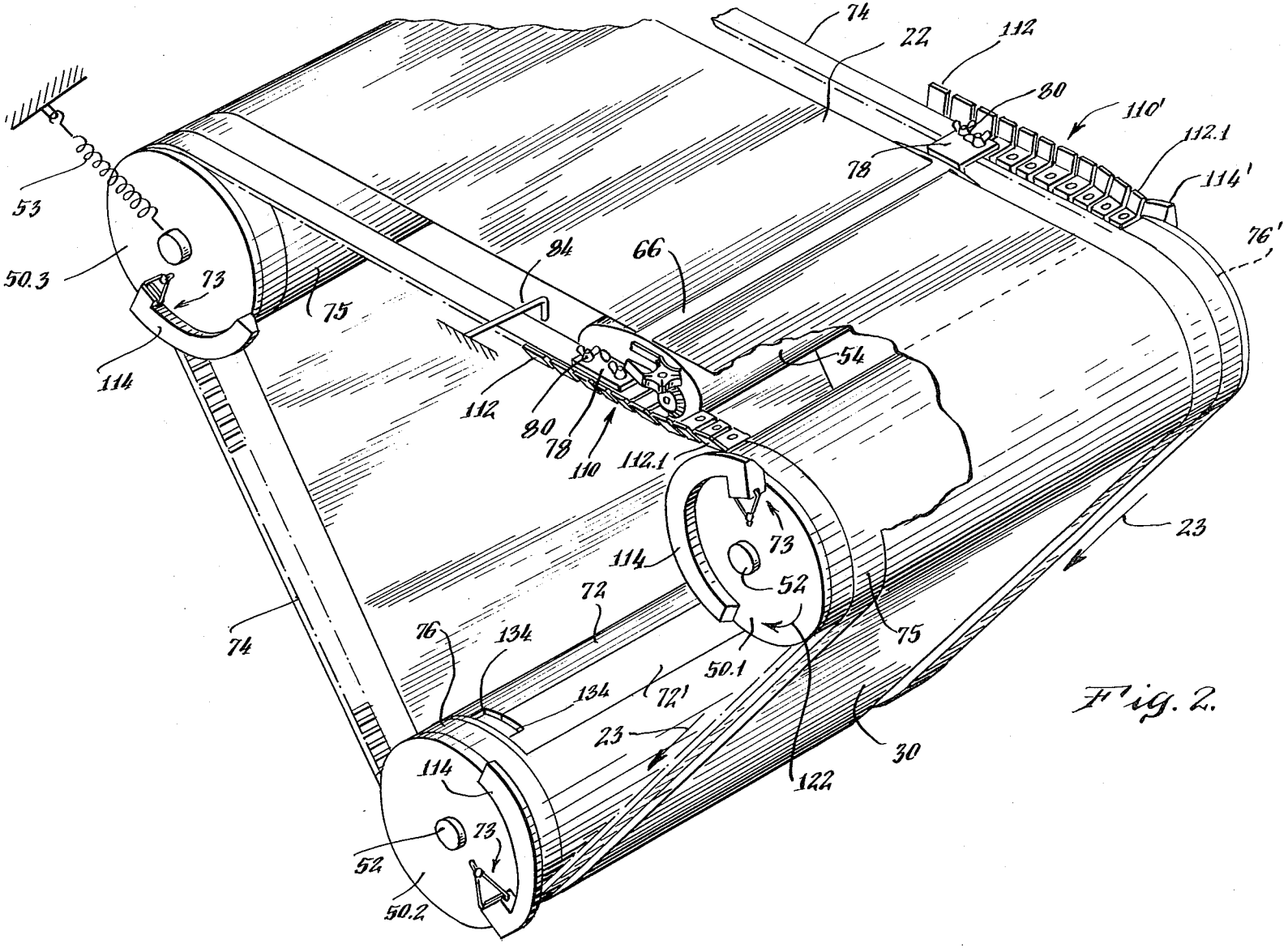
FIG. 2 is a perspective partially broken away view of a roller and photoconductor assembly in accordance with the invention.
Figure 3:
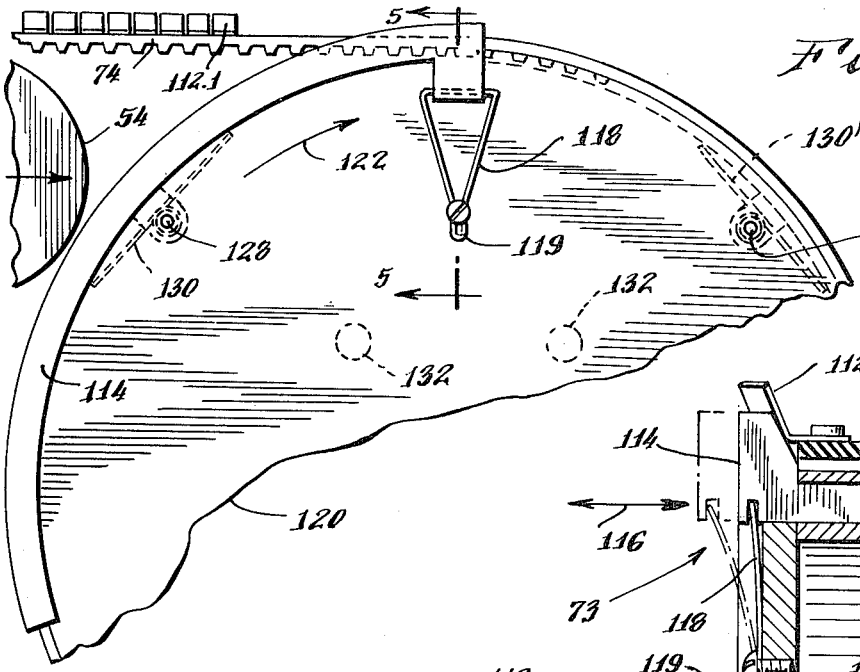
FIG. 3 is a partial side view taken parallel along the axis of rotation of a roller employed in the roller assembly shown in FIG. 2.

With reference to FIGS. 1 and 2, a photocopy machine 20 is illustrated with a photoconductor belt 22 mounted for movement along the direction of arrow 23 around a roller assembly 24 which defines a belt path 26.

Photocopy machine 20 employs various well-known operating components which are scehmatically illustrated. Thus, around belt path 26 are a photoconductor charging device 28 located just adhead of a generally flat photoconductor exposure section 30 where an optical lens system 33 forms a latent image of an object (not shown).

Exposure of the flat photoconductor section 30 is obtained with illumination from a high intensity flash source (not shown). Flash sources and their associated flash initiating circuitry are generally well-known in the art and, therefore, not illustrated. Upon exposure of the photoconductor belt 22 at a flat region 30, a latent image of the object is formed and developed by the application of toner particles from a supply 32 with a magnetic brush 34. The toner particles then are transferred to a sheet of paper 36 at a transfer station 37. A paper feed station 38 provides sheets 36 one at a time from a stack 40 for contact with the toner particle covered photoconductor 22.

After transfer of the toner image onto a sheet of paper 36, the latter is separated from the photoconductor belt 22 and advanced past a heat source 42 which fuses the toner particles into the sheet of paper. A charge eliminator 44 in the form of a light source is provided to expose the entire photoconductor belt 22 and facilitate subsequent toner removal with a brush 46 and vacuum toner remover 48. After passing of the belt cleaner 46, the photoconductor belt 22 may be again used for making a copy of an object. The actuation of the various components are properly timed with suitable switches operated in a sequence needed to complete a copy cycle. The circuitry and switches for such timing are also known in the art. A motor and drive mechanism for moving the photoconductor belt 22 around the roller assembly 24 are also known and, therefore, have been deleted for clarity of the drawings.

The roller assembly 24 is shown formed of three rollers 50.1, 50.2 and 50.3 arranged in a generally triangular fashion although different roller arrangements may be accommodated depending upon the type of photocopying machine being built. The roller assembly 24 is supported by a suitable frame which was deleted for clarity of the drawings. Each roller 50 rotates about an axis and shaft 52 which are parallel for all rollers 50. Roller 50.3 is shown spring loaded by a spring 53 to maintain tension on photoconductor belt 22 and impact some resiliency to the roller assembly.

The photoconductor belt 22 carries a replacement segment located in a cartridge 54 which moves with belt 22 around rollers 50 and thus the entire belt path 26. One end of the photoconductor belt 22 is connected to a supply reel 56 in cartridge 54. Supply reel 56 carries a rolled up replacement segment 58 (see FIG. 9) of the photoconductor belt 22. The other end of the photoconductor belt is connected to a take-up reel 60 in cartridge 54. The take-up reel 60 serves to store used segments of photoconductor material. The fresh and used segments of the photoconductor material.

The fresh and used segments of the photoconductor belt are passed through appropriate slits 62, 64 (see also FIG. 9) in the cartridge 54. A slit closure element 66 (see also FIG. 9) is provided to inhibit toner particles from entering the inside of cartridge 54.

The cartridge 54 is formed of a generally light-weight material, such as plastic, so that the photoconductor belt 22 may support the cartridge 54 and its contents without undue or operationally significant physical distortions of the photoconductor produced by excessive tensions, bends or flexure problems.

The photoconductor belt 22 and its attached cartridge 54 form a unified assembly which is replaced in its entirety when the photoconductor belt has been used.

Since the cartridge 54 is located on the inside of the photoconductor belt path 26, the passage of the cartridge over the rollers 50 is accomplished with a cartridge receiving recess 70 in each of the rollers 50. The cartridge position along belt path 26 is slected in such manner that as the cartridge 54 approaches a roller 50, a synchronized meshing with the roller receiving recess 70 for entry thereof is established. In this manner the photoconductor belt 22 may be continuously moved around the path 26 while the belt is kept sufficiently taut.

Each recess 70 is normally covered with a pair of doors 72-72' that may be locked into a closed position with a locking mechanism 73 located at each axial end of a roller 50. The covers 72 are curved to provide a continuous peripheral surface with the cylindrical surfaces 75 of rollers 50.

The mounting of the photoconductor belt and cartridge assembly is established with precise synchronization relative to the roller recess 70 so that the cartridge 54 will properly enter a recess 70 during belt motion. In addition, the rotations of the rollers 50 are synchronized with each other with a pair of axially end located timing belts 74-74' spanning the belt path 26. Timing belts 74 couple to axially end located timing ring gears 76-76' on each roller 50. The mounting of the photoconductor belt 22 and cartridge 54 with timing belts 74-74' on the roller assembly 24 may include a collapsible assembly as shown, for example, in the art, U.S. Patent to Gardner et al U.S. Pat. No. 3,521,950 and those sections thereof dealing with a roller assembly module as shown in FIG. 18. Thus a roller 50 may be moved inwardly to enable one to fit the photoconductor belt around the belt path.

Figure 6:
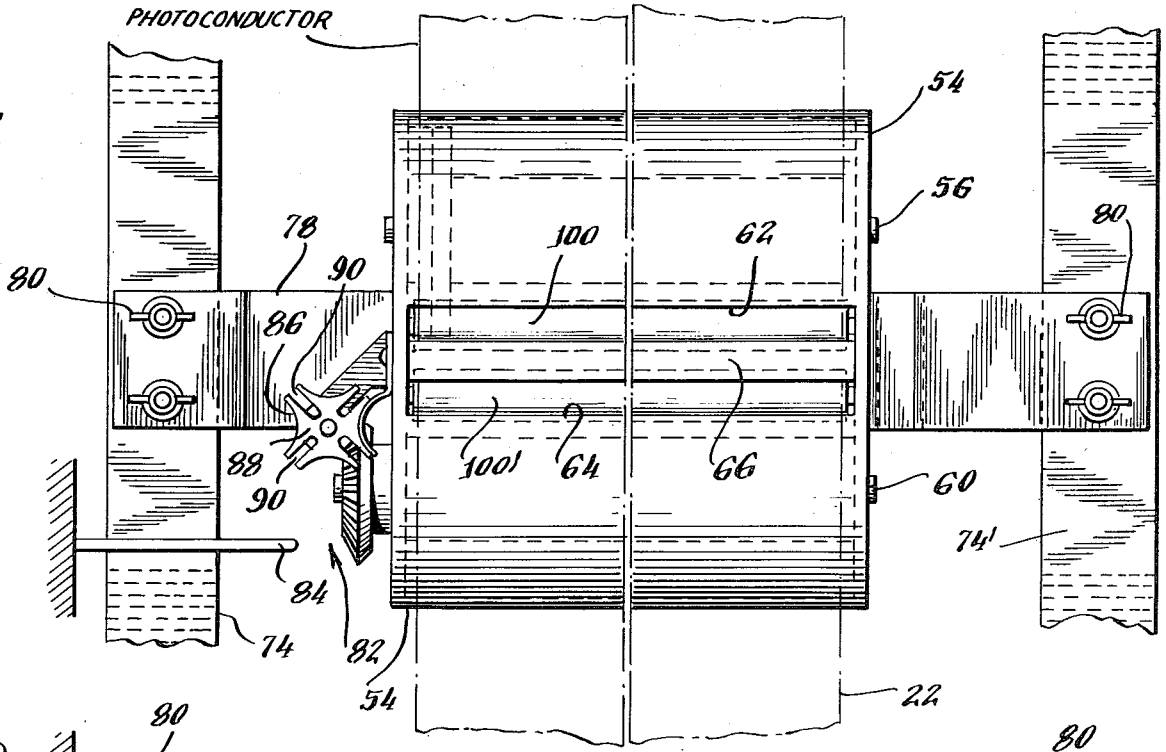
FIG. 6 is a top plan view of a portion of the photoconductor belt and cartridge shown in FIG. 2.

The photoconductor belt 22 and cartridge 54 are located between the timing belts 74 as can be seen in the views of FIGS. 2 and 6. The cartridge 54 is attached to the belts 74 with an extension bracket 78. Bracket 78 may be attached to timing belts 74 at different locations by adjusting wing clamps 80. Such lengthwise adjustment thus enables precise registration and proper synchronous arrival of the cartridge 54 relative to recesses 70. Appropriate alignment indications are provided on belts 74 to aid the desired registration of cartridge 54 relative to rollers 50 and their recesses 70.

Figure 7:
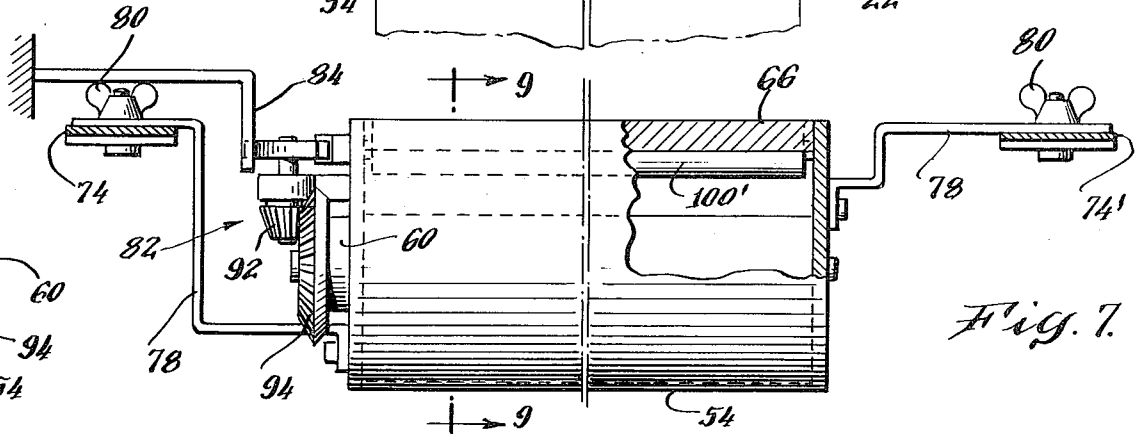
FIG. 7 is an end view in elevation of the photoconductor belt and cartridge shown in FIG. 6.
Figure 8:
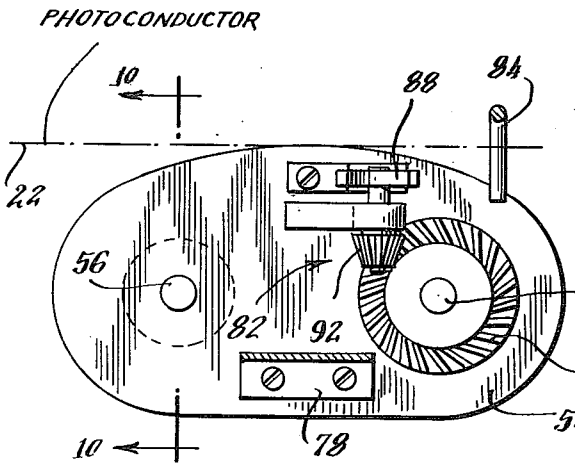
FIG. 8 is a side view of the photoconductor belt and cartridge as shown in FIG. 7.

A desirable feature of the photoconductor belt assembly in accordance with the invention resides in the ability to replace deteriorated photoconductor belt segments in an automatic continual manner. A belt replacement drive 82 (see FIGS. 6, 7 and 8) is mounted on the cartridge 54 and coupled to the take-up reel 60 to cause an incremental rotation thereof with each complete cycle of the photoconductor belt 22 about path 26.

The drive 82 is formed with a stationary pin 84 mounted to a frame (not shown) near the path along which the cartridge 54 travels. The stationary pin 84 engages a Geneva mechanism 86 on cartridge 54 formed of a maltese cross shaped actuator 88 having four corner located slots 90 arranged to engage pin 84. The actuator 88 is connected to a pinion 92 which is coupled through reduction gearing formed of a spiral gear 94 to the shaft of take-up reel 60.

Hence, as the photoconductor belt 22 is driven around the belt path 26, pin 84 is caused to engage a slot 90, thus causing a one-quarter turn of the actuator 88 and its connected pinion 92. The speed reduction obtained between pinion 92 and spiral gear 94 reduces the rotational drive of the take-up reel 60 to a small fraction of an inch.

The incremental advance of photoconductor belt replacements by the take-up reel 60 is selected on the basis of the number of quality copies that can be made with any one segment of the photoconductor belt 22. For example, if one can make 5,000 quality copies which are 10 inches long, as measured along path 26, then after 5,000 cycles 10 inches of photoconductor material must have been replaced. This would require at least 0.002 inch (two thousandth's of an inch) effective take-up belt or replacement motion by take-up reel 60 for each cycle. If actuator 88 undergoes about one-quarter inch rotational motion, a speed reduction of about 125:1 is needed to establish a precise 0.002 inch incremental belt replacement. When an advance or replacement of the order of 0.005 inch for each cycle is needed, the reduction ratio becomes of the order of 50:1.

Actually, the incremental replacement introduced by the actuation of the Geneva mechanism 86 will vary depending upon the effective radius of the take-up reel 60. Thus initially the incremental advance may be somewhat less than 0.002 inches while the advance will increase as more photoconductor belt is wound onto take-up reel 60.

The total amount of photoconductor belt material that can be stored by cartridge 54 determines the effective lifetime of the entire belt assembly. Since replacement is carried out on a continual basis, i.e. by small increments measured in fractions of an inch, the quality of the copies will be generally consistent. The incremental advance may be varied depending upon the type of photoconductor material and the acceptable level of quality. The range of incremental advances may vary, by selecting the reduction ratio, or by altering the diameter of the take-up reel 60 or by producing an incremental advance for every two or several number of cycles or combinations thereof. Generally the incremental replacement is selected small in comparison with the length of the image or the length of the photoconductor belt path to enable the gradual photoconductor belt replacement.

The incremental advance or replacement of the photoconductor is particularly advantageous in distributing physical loading such as may be caused at bending points. Thus, the entry and departure of the cartridge 54 relative to a roller recess 70 may involve shape changes whose damaging effects on the photoconductor tend to be reduced by its continual replacement.

The incremental replacement of the photoconductor is preferably of such small amount that the initial resulting increase in tension is negligible. The small additional take-up tends to be distributed over the entire photoconductor belt 22 as the latter with its cartridge 54 is moved through a copying cycle over the various rollers 50.

The quantity of fresh photoconductor belt material on the supply reel 56 is selected to achieve a desired total copying capability for the belt and cartridge assembly. The maximum storage of photoconductor belt material within the cartridge 54 must be limited to maintain the cartridge size to enable its passage past rollers 50.

Figure 9:
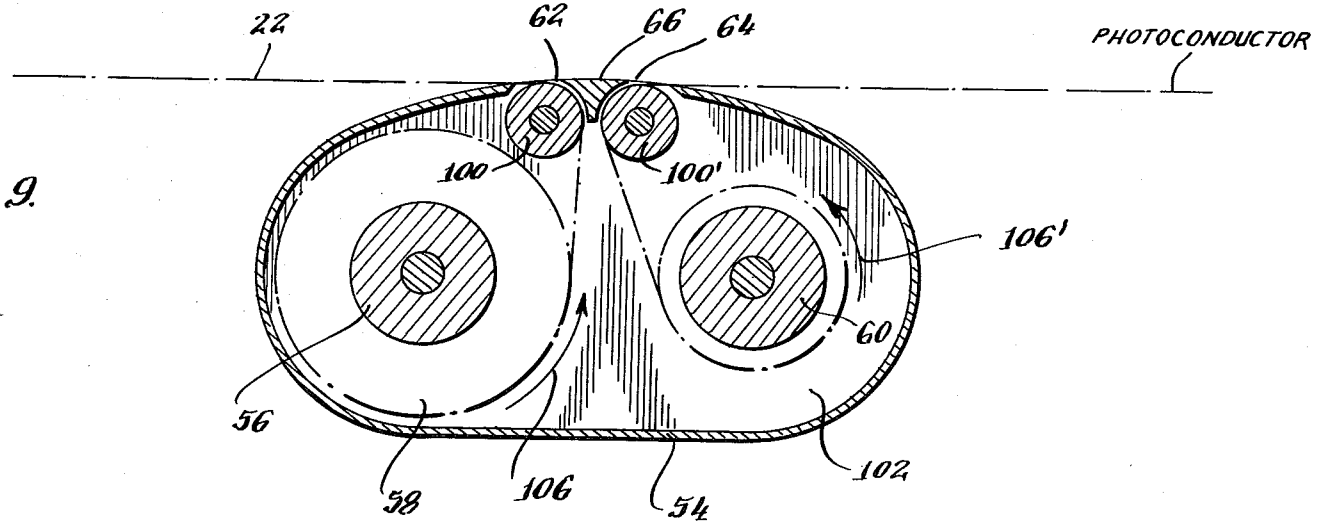
FIG. 9 is a section view of the photoconductor belt cartridge as taken along the line 9—9 in FIG. 7.
Figure 10:
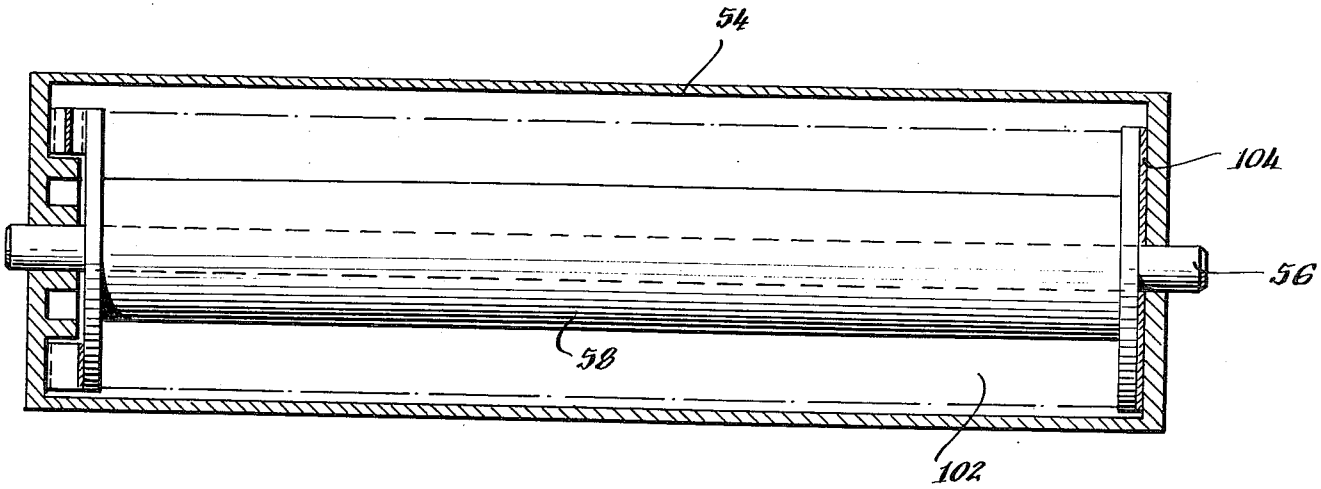
FIG. 10 is an enlarged section view of the photoconductor belt cartridge taken along the line 10—10 in FIG. 8.

As shown in FIG. 9 the cartridge 54 includes a pair of output idlers 100, 100' which are located adjacent slits 62, 64 respectively. Idlers 100 facilitate the transfer of photoconductor belt 22 out of and into the cartridge recess 102. The supply reel 56 is mounted with a friction disc 104 (see FIG. 10) adjacent an axial end to inhibit free rotation of supply reel 56 and provide a minimum of tension in the photoconductor belt 22. Other restraining elements could be used such as a spring loading of supply reel 56. The rotations of supply reel 56 and take-up reel 60 are in the directions indicated by arrows 106-106'.

The arrival of the cartridge 54 at any one of rollers 50 is accompanied by an opening of doors 72. The respective mechanisms for accomplishing the insertion of the cartridge 54 into recess may be conveniently explained with reference to FIGS. 2, 3, 4 and 5. The timing belts 74-74' are each provided with cams 110-110' respectively formed of outwardly projecting studs 112 sized to engage locking mechanism 73. Each locking mechanism 73 is formed of an annular lever segment 114 extending radially above the peripheral surface 75 of rollers 50 at axial ends thereof.

Figure 5:
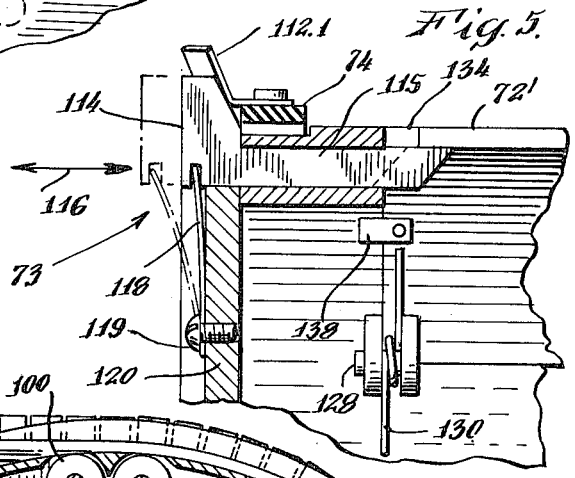
FIG. 5 is a partial section view of a roller taken along the line 5—5 in FIG. 3.

As shown in FIG. 5, the annular lever segments 114 are provided with an axial bolt extension 115 mounted to slide in the direction of double headed arrow 116 below both doors 72-72'. A spring 118 which has an end 119 anchored to an end wall 120 of rollers 50 urges each bolt extension into a door locking position as shown in solid lines in FIG. 5.

When the cams 110-110' arrive, generally at about the same time, at roller 50, the front or forward cam studs 112 will engage annular lever segments 114-114' and gradually force them outwardly as the rollers rotate in the direction of arrow 112 and the photoconductor belt moves clockwise in the direction of arrow 23. By the time the cartridge 54 arrives at a recess 70, the locking bolt 115 will have been cammed out to the position indicated in dotted lines in FIG. 5, thereby enabling doors 70 to open inwardly.

Figure 4:
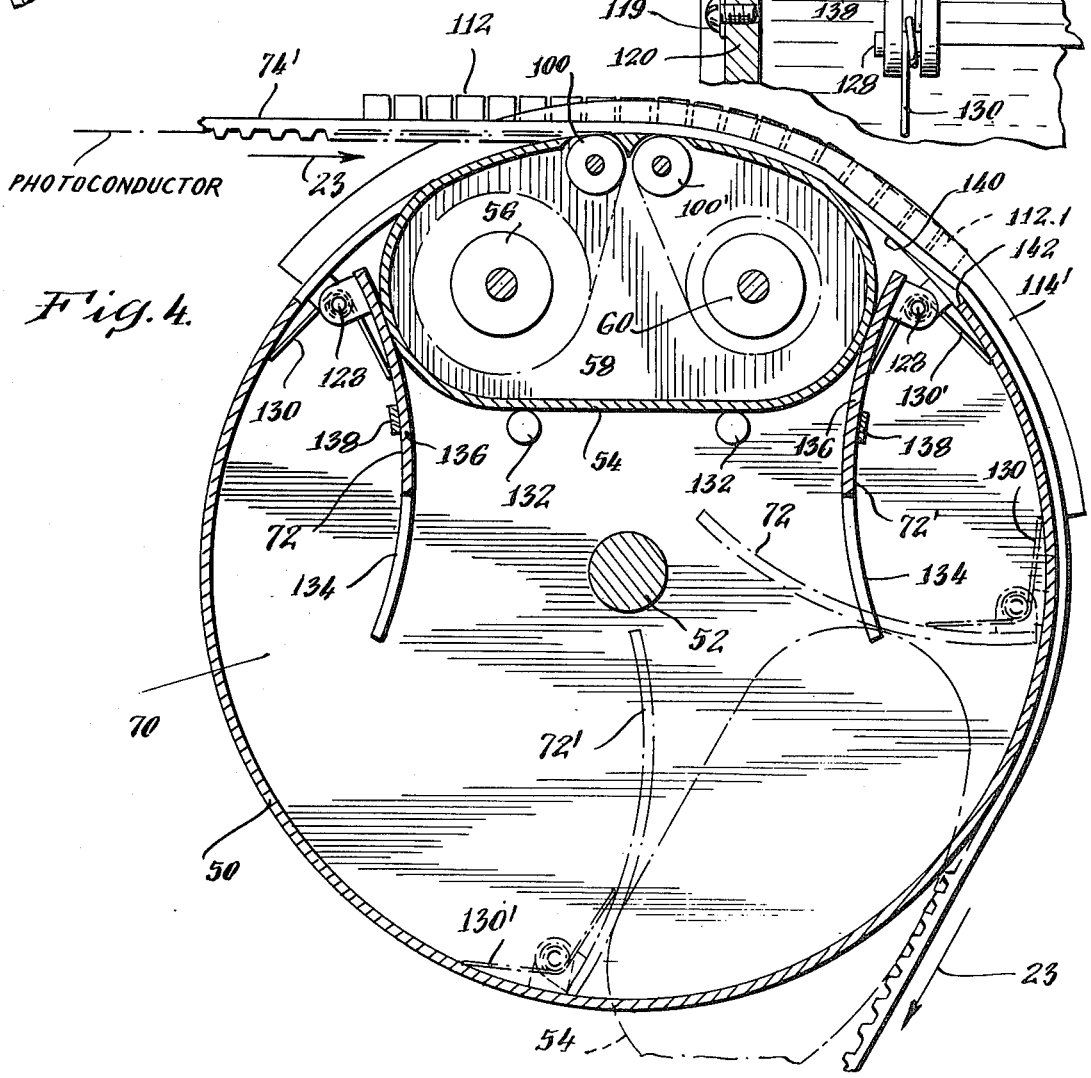
FIG. 4 is a section view of a roller and its recess with a cartridge of a photoconductor belt located in the recess for sequential rotational positions of the roller.

Both doors 72-72' are pivotally mounted at pivots 128 and urged in a closed position with springs 130-130' respectively to preserve the cylindrical shape of roller 50. As the cartridge 54 arrives, it forces doors 72 open to their open position as shown in FIG. 4. When the cartridge 54 has fully entered recess 70, a pair of studs 132 arrest further inward movement. Studs 132 are mounted on roller end walls 120-120' and extend axially into the cartridge recess 70 for a distance sufficient to seat the bottom wall of cartridge 74. Since, as shown in FIG. 4, doors 72 swing past studs 132, each door is provided with end located cut-outs 134. These cut-outs are sufficiently narrow, as shown in FIG. 5, to prevent affecting the photoconductor 22. Segments 136 of doors 72 are provided with axial extensions 138 which engage the outer wall of rollers 50 to firmly seat doors 72 in their closed position.

The annual extended shape of the lever segments 114 is provided to assure an unlocking or released position of the bolt segments 115 throughout the passage of the cartridge 54 past a roller 50. As shown in FIG. 4, the length of cam 110 or number of studs 112 is selected to maintain cam contact from the time a cartridge enters a recess 70 until the time it has left a recess. As a result, the bolt segment 115 will remain open until the doors 72 have been reclosed and then slides in under pressure from springs 118 to lock the doors in their closed position.

As shown in FIG. 4 the entry of cartridge 54 into recess 70 of roller 50 is accompanied with a readjustment of the photoconductor belt 22. Thus when cartridge 54 is seated on studs 132, a straight segment 140 of belt 22 is formed between cartridge 54 and the edge 142 of the peripheral wall of roller 50. The photoconductor thus undergoes shape changes as its cartridge is moved past a roller. Since any one belt section is gradually replaced, it will not be subjected to excessive stresses over an extended time; hence, any discontinuities presented in the photoconductor belt, such as when cartridge 54 is moving past a roller 50, can be tolerated.

The operation of the photocopying machine 20 includes suitable timing controls to preferably expose the photoconductor belt 22 at the most appropriate time. Thus when the cartridge 54 is in transit between rollers and the closure elements operative with recesses 70 assure a firm cylindrical surface of rollers 50, belt 22 has a generally constant tension force and is free from disturbance to enable the formation of an unblurred latent image. In a similar manner, the transfer of the toner particles from the latent image onto a sheet of paper is timed to occur when the photoconductor movement is steady.

The operation thus includes a continuous movement of the photoconductor belt around the belt path while it is being gradually replaced by the incremental take-up action of the take-up roller. The incremental advance may vary in size, depending upon the number of rollers, the size of the take-up roller and the replacement rate of the photoconductor.

Having thus described a photocopy machine in accordance with the invention, its advantages may be appreciated. A belt photoconductor of a relatively low copy producing capability per unit length may be used with flash exposures, yet with a long over-all effective lifetime. The gradual replacement of the photoconductor provides a convenient method to assure a high quality of copies.

What is claimed is:

1. A method for effectively extending the lifetime of a photoconductor belt used in a photocopy machine comprising the steps of:

moving the photoconductor belt around a belt path for the exposure to an image of an object followed by the development of the image on a sheet of paper;

storing a supply of fresh photoconductor material in connected relationship with the photoconductor belt and movable therewith around the entire circumference of the belt path; and incrementally replacing the photoconductor belt with fresh segments from the supply of fresh photoconductor material to gradually replace the photoconductor belt around the belt path.

2. The method for effectively extending the lifetime of a photoconductor as claimed in claim 1 wherein the incremental replacing step consists of replacing the photoconductor belt with segments which are small in relation with the photoconductor belt path.

3. The method for effectively extending the lifetime of a photoconductor as claimed in claim 1 wherein the replacing step consists of replacing the photoconductor belt during its movement around the path with increments of the order of a fraction of an inch.

4. The method for effectively extending the lifetime of a photoconductor belt used in a photocopy machine as claimed in claim 3 wherein the incremental replacing step is selected in size commensurate with a desired number of copies and the type of photoconductor belt material.

5. The method for effectively extending the lifetime of a photoconductor belt used in a photocopy machine as claimed in claim 1 and further including the step of storing incremental used photoconductor segments in correspondence with the incremental replacement thereof.

6. The method for effectively extending the lifetime of a photoconductor belt used in a photocopy machine as claimed in claim 3 wherein the incremental replacing step is carried out each time the photoconductor belt has moved a predetermined number of times around the belt path.

7. The method for effectively extending the lifetime of a photoconductor belt used in a photocopy machine as claimed in claim 6 wherein the incremental replacing step is carried out each time the photoconductor belt has moved around the belt path.

* * * * *